US009273932B2

(12) United States Patent
Whitaker et al.

(10) Patent No.: US 9,273,932 B2
(45) Date of Patent: Mar. 1, 2016

(54) METHOD OF MANUFACTURE OF COMPOSITE ARMOR MATERIAL

(75) Inventors: John D. Whitaker, Seattle, WA (US); Christina Lomasney, Sammamish, WA (US)

(73) Assignee: Modumetal, Inc., Seattle, WA (US)

( * ) Notice: Subject to any disclaimer, the term of this patent is extended or adjusted under 35 U.S.C. 154(b) by 0 days.

(21) Appl. No.: 12/330,126

(22) Filed: Dec. 8, 2008

(65) Prior Publication Data

US 2009/0217812 A1 Sep. 3, 2009

Related U.S. Application Data

(60) Provisional application No. 60/992,877, filed on Dec. 6, 2007.

(51) Int. Cl.

| | |
|---|---|
| ***F41H 5/04*** | (2006.01) |
| ***C25D 5/18*** | (2006.01) |
| ***F41H 5/00*** | (2006.01) |
| ***F41H 5/02*** | (2006.01) |
| ***C25D 5/14*** | (2006.01) |
| ***C25D 15/02*** | (2006.01) |
| ***C25D 13/18*** | (2006.01) |
| ***C25D 7/00*** | (2006.01) |
| ***C25D 5/10*** | (2006.01) |
| ***C25D 15/00*** | (2006.01) |
| *C25D 5/12* | (2006.01) |

(52) U.S. Cl.

CPC ..... *F41H 5/0457* (2013.01); *C25D 5/10* (2013.01); *C25D 5/14* (2013.01); *C25D 5/18* (2013.01); *C25D 7/00* (2013.01); *C25D 13/18* (2013.01); *C25D 15/00* (2013.01); *C25D 15/02* (2013.01); *F41H 5/00* (2013.01); *F41H 5/02* (2013.01); *F41H 5/04* (2013.01); *F41H 5/0414* (2013.01); *F41H 5/0421* (2013.01); *F41H 5/0428* (2013.01); *F41H 5/0442* (2013.01); *F41H 5/0464* (2013.01); *F41H 5/0471* (2013.01); *F41H 5/0492* (2013.01); *C25D 5/12* (2013.01)

(58) Field of Classification Search
None
See application file for complete search history.

(56) References Cited

U.S. PATENT DOCUMENTS

| | | | | |
|---|---|---|---|---|
| 2,642,654 | A * | 6/1953 | Ahrens | 428/566 |
| 5,268,235 | A * | 12/1993 | Lashmore et al. | 428/610 |
| 2009/0130425 | A1 * | 5/2009 | Whitaker | 428/312.8 |

FOREIGN PATENT DOCUMENTS

WO WO 2007/021980 * 2/2007

OTHER PUBLICATIONS

Material Safety Data Sheet, CFOAM Carbon Foams, Aug. 2008.*

* cited by examiner

*Primary Examiner* — Michael E La Villa
(74) *Attorney, Agent, or Firm* — Perkins Coie LLP

(57) ABSTRACT

An armor material and method of manufacturing utilize nano- and/or microlaminate materials. In one embodiment, the armor material comprises a layered composite material including a strike face, a core layer, and a spall liner. The strike face achieves hardness and toughness by the controlled placement of hard and tough constituent materials through the use of nano- and/or microlaminate materials. The core layer achieves energy absorption through the use of nano- or microlaminated coated compliant materials. The spall liner provides reinforcement through the use of nano- or microlaminated fiber reinforced panels. In one embodiment, nano- and/or microlaminated materials can be manufactured through the use of electrodeposition techniques.

15 Claims, 13 Drawing Sheets

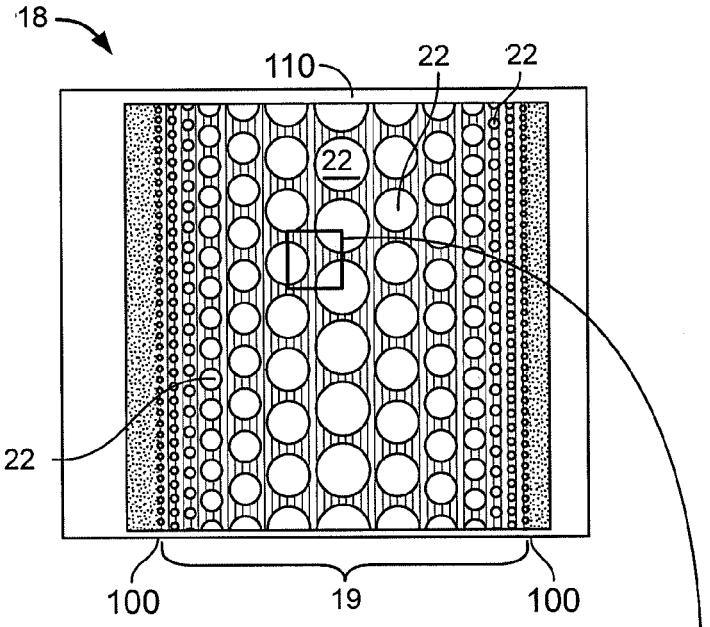
FIG. 14A
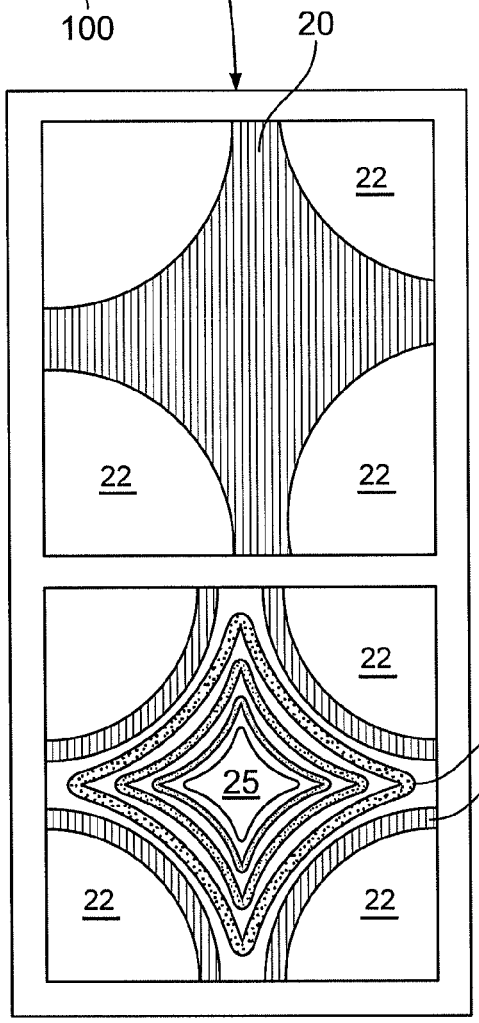
FIG. 15A
FIG. 15B

METHOD OF MANUFACTURE OF COMPOSITE ARMOR MATERIAL

RELATED APPLICATIONS

This application claims the benefit of U.S. Provisional Application Ser. No. 60/992,877, entitled "Composite Armor Material and Method of Manufacture", filed on Dec. 6, 2007. The entire disclosure of U.S. Ser. No. 60/992,877 is incorporated herein by reference.

FIELD OF THE DISCLOSURE

This disclosure relates to composite armor materials and methods of manufacturing such a materials. Armor produced using the disclosed methods and composite armor materials can include one or more of the following advantages: a) an outer layer or strike face providing excellent hardness and toughness b) a middle or core layer that absorbs substantial compressive energy and substantially impedes pressure waves associated with ballistic impact, and c) an inner layer (i.e., a spall liner) having improved reinforcement to prevent ballistic penetration. Additional advantages afforded by the claimed material include resistance to chemical attack, a high strength-to-weight ratio, and easy production of a multitude of armor geometries.

BACKGROUND

Armor has been used throughout history as protective clothing or outer layer intended to prevent harm from projectiles. Today's advanced armor is a layered composite material. In general, modern composite armor includes three layers: (1) an outer region also known as a strike face that is intended to blunt and disrupt the impact of an incoming projectile and to distribute the resulting force, (2) a middle or core region designed to absorb energy and attenuate pressure waves, and (3) an inner region known as a spall liner to minimize and/or prevent complete penetration of the projectile or blast by-products.

SUMMARY OF THE DISCLOSURE

The present disclosure applies to materials used in armor (e.g., armored clothing/fabric, armored vehicles) and methods of manufacturing such materials. By employing deposition (e.g. electrodeposition) of laminate materials (e.g., nanolaminate materials, microlaminate materials), greater strength-to-weight ratios can be achieved as compared with conventional armor. In addition, the strike face of the disclosed material has excellent hardness and toughness, the core region can absorb substantial compressive energy and attenuate pressure waves, while the spall liner provides reinforcement to prevent ballistic or blast by-product penetration as compared to conventional armor. Methods described herein (e.g., electrodeposition) provide advantages including the ability to produce a multitude of armor geometries and the ability to create a cohesive layered material, i.e., a well-bonded layered material whose layers/regions work together to minimize damage from an impacting projectile.

One aspect of the present disclosure is to provide a layered material that minimizes damage caused by an impacting projectile. The layered material includes a strike face region that blunts and disrupts the impacting projectile and distributes the force of impact over a comparatively large area; a core region designed to absorb energy from an impacting projectile and attenuate blast-induced pressure waves; and a spall liner region adapted to prevent penetration by-products of the impacting projectile. The strike face can include a compositionally or structurally modulated nanolaminate material that modulates between hard and tough constituent materials or phases. The core region can include a nano- or microlaminate material that reinforces a compliant phase material such as, for example, a polymer or foam. The spall liner can include a nano- or microlaminate reinforced long-range periodic material, such as fibrous material.

In another aspect, embodiments described in the present disclosure are directed to composite armor material comprising a plurality of layers, wherein the plurality of layers comprises an electrodeposited modulated material including a modulation wavelength less than about 1000 microns. Such embodiments can include one or more of the following features. The composite armor material may comprise a porous substrate including an accessible interior void structure at least partially filled with the electrodeposited modulated material. The composite armor material may be compositionally modulated. In some embodiments, the composite armor material may be structurally modulated.

Embodiments of this aspect of the disclosure can also include one or more of the following features. In some embodiments, the composite armor material can have a plurality of layers arranged to define a strike face region, a core region, and a spall liner region, where the strike face region provides toughness and hardness to distribute force of an impacting projectile, and the core region provides energy absorption to absorb energy from the impacting projectile, and the spall region provides strength to inhibit penetration of the armor material. The strike face region may comprise a periodic hard-tough transitions, wherein the periodic hard-tough transitions may be graded. In some embodiments, the strike face region comprises a laminated material. In some embodiments, the core region comprises a metal phase and a compliant phase, wherein the metal phase may comprise a laminated material, and the compliant phase may include a porous template, in which void regions of the porous template may be filled by a gas or liquid. In some embodiments, the compliant phase may include a low density solid, such as a polymer or a foam having a density of less than about 5 g/cc. In some embodiments, the spall liner region of the composite armor material may comprise fibers and a laminated material, wherein the fibers may be reinforced with a sheath formed of the laminated material, and the fibers may be disposed within a matrix of the laminated material. In other embodiments, the boundaries between regions of the plurality of layers in the composite armor material are graded.

Another aspect of this disclosure is to provide a method for the manufacture of a composite armor material, wherein one or more of the regions within the material is produced through electrodeposition. For example, at least one of the strike face region, core region, and spall liner region is made using electrodeposition of nanolaminate or microlaminate materials.

In another aspect, embodiments described herein are directed to methods of producing a composite armor material. The methods includes providing an electrolyte containing a metal; providing a porous substrate; immersing the porous substrate in the electrolyte; passing an electric current through the porous substrate so as to deposit the metal onto the porous substrate; and changing one or more plating parameters in predetermined durations between a first value, which is known to produce a material with one property, and a second value, known to produce a material with a second property, to form a portion of at least one of a strike face region, a core region, and a spall liner region.

Embodiments of the above methods can also include one or more of the following features. The plating parameter of the method can include one or more of pH set point value of the electrolyte bath, electrolyte composition of the bath, applied plating current, applied plating voltage, and mass transfer rate. The plating parameter can be change, in some embodiments, according to one of a square wave, a triangle wave, and a sine wave.

BRIEF DESCRIPTION OF THE DRAWINGS

In the drawings, like reference characters generally refer to the same parts throughout the different views. Also the drawings are not necessarily to scale, emphasis instead being placed upon illustrating the principles of the disclosure.

FIGS. 9*b* and 9*c* are illustrations of another porous substrate reinforced with electrodeposited metal. Specifically, FIG. 9*b* is an illustration of a reticulated foam including 6 struts and FIG. 9*c* is a cross-sectional view of one of the struts showing the nanolaminated metal reinforcing the strut (substrate).

FIG. 13*a* is a plot of applied frequency to a working electrode in an electrochemical cell versus time. FIG. 13*b* is a plot of applied amplitude to a working electrode in the electrochemical cell versus time. FIG. 13*c* is a plot of applied current density to a working electrode in the electrochemical cell versus time. FIG. 13*d* is an envisioned resulting deposit compositional map corresponding to the applied current density given in FIG. 13*c*, that is for one frequency modulation cycle. FIG. 13*d* is an envisioned compositional map corresponding to application of ten frequency modulation cycles of deposition.

FIGS. 14*a*-14*c* are illustrations of cross-sectional views of various embodiments of composite materials. FIG. 14*a* is an illustration of a composite including an electrochemically infused particle bed having a particle distribution that gradually increases from the exterior surfaces of the composite into the center of the composite. FIGS. 14*b* and 14*c* are other illustrations of a composite including an electrochemically infused particle bed. In FIG. 14*b*, the particles have a repeating size distribution. In FIG. 14*c* the particles have a graded size distribution.

FIGS. 15*a* and 15*b* are illustrations of two separate embodiments of a compositionally modulated material disposed within the void structure of four particles.

DETAILED DESCRIPTION

Figure 1:
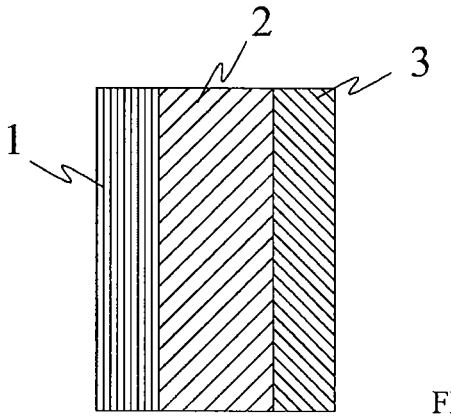
FIG. 1 is an illustration of a cross-sectional view of an electrodeposited armor.

Referring to the drawings, FIG. 1 illustrates one embodiment of an electrodeposited composite armor comprising 1) a hard strike face intended to a) blunt and disrupt impacting projectiles and b) distribute the force of impact over a comparatively large area; 2) an energy absorbing core designed to a) absorb additional energy from the impacting projectile and b) attenuate blast-induced pressure waves; and 3) a spall liner designed to prevent complete penetration by products of the impact event. One or more additional regions can be added to the embodiment of FIG. 1.

Features of the strike face (1) include both superior hardness and toughness, which can be achieved by the controlled placement of hard and tough constituent materials within the strike face volume. Periodic hard-tough transitions can serve to arrest crack growth and improve fracture toughness.

Figure 2:
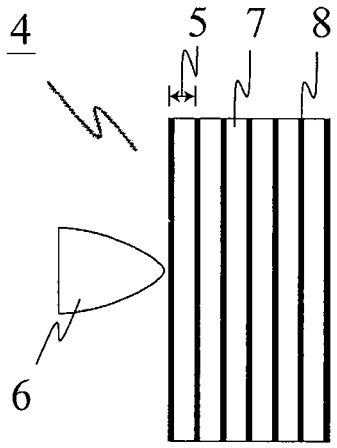
FIG. 2 is a an illustration of a cross-sectional view of a strike face region of the electrodeposited armor of FIG. 1.
Figure 3:
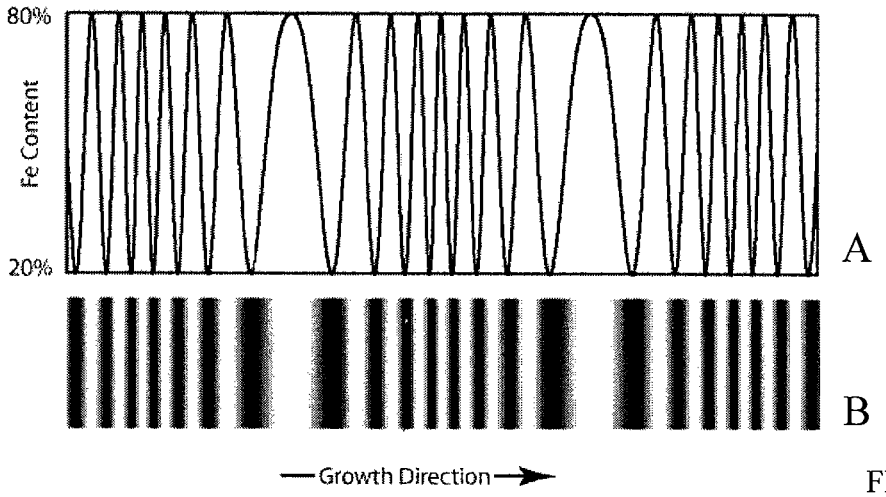
FIG. 3A is a graph showing a waveform of iron content in a nickel-iron compositionally modulated electrodeposited material and FIG. 3B is a corresponding composition map.

Referring to FIG. 2, the strike face, for example, may consist of a thick compositionally or structurally modulated material (4) with a modulation wavelength (5) varying between 1 and 1000 nm. The local hardness within the deposit can be controlled through the modulation wavelength, the grain size, and/or the composition/phase. Above a certain minimum, typically 2-20 nm, smaller modulation wavelengths produce stronger, harder deposits through Hall-Petch strengthening. Below this wavelength cutoff (e.g., less than about 2-20 nm), hardness and strength decrease with decreasing wavelength. Wavelength modulations therefore can impart modulations in the local hardness of the laminate. For example, it is believed that as the wavelength decreases from 1000 nm towards ~2-20 nm, hardness and strength increases; once below the 2-20 nm range, it is believed that the strength and hardness begin to decrease. The same approach holds true with structurally modulated materials, such as materials that are modulated in grain size or phase. For example, in embodiments where the grain size is modulated, hardness peaks at a grain size of approximately 2-20 nm. For example, in alloy systems which exhibit phase transitions such as fcc→bcc at a given alloy composition, a comparatively ductile fcc alloy can be interposed between strong and hard bcc material to form the structurally (phase) modulated material. The strike face may also contain ceramic particles such as boron carbide, silicon carbide, silicon nitride, or alumina embedded within the electrodeposited metal matrix, which may itself be a compositionally modulated alloy as described above. Modulating the concentration of ceramic inclusions would provide additional hardness modulation, and would additionally function to abrade impacting projectiles (6). Hard regions (7) may therefore be characterized by of one or more of the following: 1-20 nm grains, 2-20 nm wavelengths, bcc phases, and ceramic particle-rich regions, while tough regions (8) include one or more of the following >20 nm grains or wavelengths, <2 nm grains or wavelengths, regions of low/no ceramic inclusions, and fcc phases. In all of the cases described above, an additional embodiment may include gradation of the transition between hard and tough regions, such that the interface is blurred and delamination impaired as shown in FIG. 3.

Figure 4:
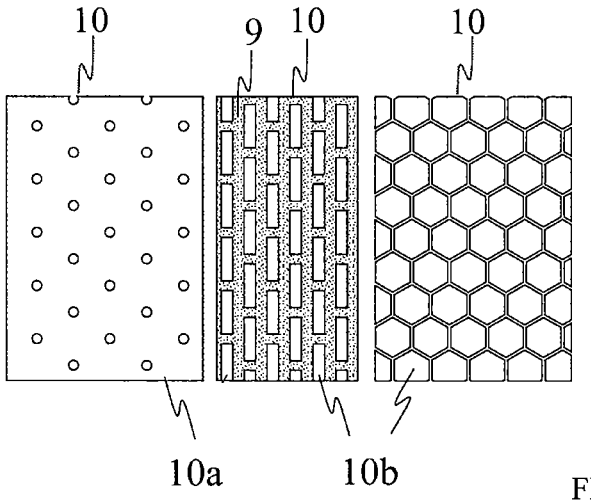
FIG. 4 is an illustration of several embodiments of a porous template.

In some embodiments, such as illustrated in FIG. 4, strike faces may be produced by electrodepositing a tough metal phase (9) through one or more hard ceramic templates (10; i.e., a substrate, a porous substrate) including, for example, perforated ceramic plates (10*a*) and/or arrays of ceramic tiles (10*b*). The metal phase may itself be nano- and/or microlaminated. The ceramic template may be modified, either by surface functionalization or roughening, to optimize the adhesion between itself and the metal.

Figure 5:
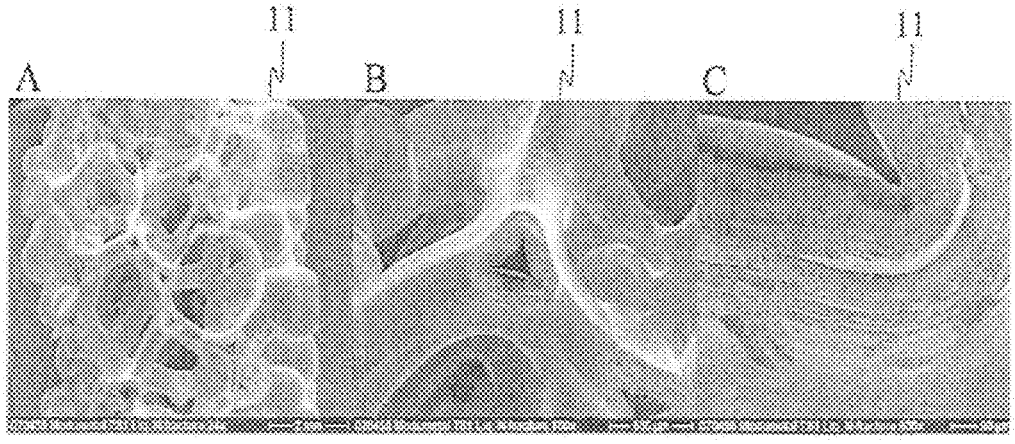
FIG. 5*a* is a scanning electronmicrograph (SEM) image of a liquid nitrogen-chilled fracture surface of a metal nanolaminate deposited over a reticulated foam substrate at a magnification of 24×.
FIG. 5*b* is a SEM image of the same fracture surface at a magnification of 100×.
FIG. 5*c* is a SEM image of the same fracture surface at a magnification of 600×.

The energy-absorbing material of the core layer (2) includes a minor volume fraction (<50%, e.g., 45%, 40%, 35%, 30%, 25%, 20%, 15%, 10%, 5%) metal phase reinforcing and/or binding an otherwise soft/compliant phase, which may include gases, liquids, or solids such as polymers or low density solids (e.g., <5 g/cc). An example of such a core material is a reticulated foam reinforced with a metal nano-/microlaminate coating (11) as shown in FIGS. 5*a*, 5*b*, and 5*c*. Another embodiment may include polymeric or foam templates (porous templates), analogous to the ceramic templates described above in FIG. 4 (10*a, b*), which have been infiltrated with nano- or micro-laminated metal having the structures described in the paragraphs accompanying FIG. 2 above. The common feature of these core designs is their substantial compressive energy absorption and their impedance to pressure waves induced by blasts. Thus, a core region material has a compliant phase (e.g., a foam, or other porous material, which can include a compliant solid such as a polymer) having a form which absorbs energy (e.g., a foam, a bed of beads filled with a liquid or gas.) The core region also includes a metal phase that reinforces and or binds (e.g. encapsulates bed of beads, nanolaminate coating on exterior of foam) the compliant phase.

Figure 6:
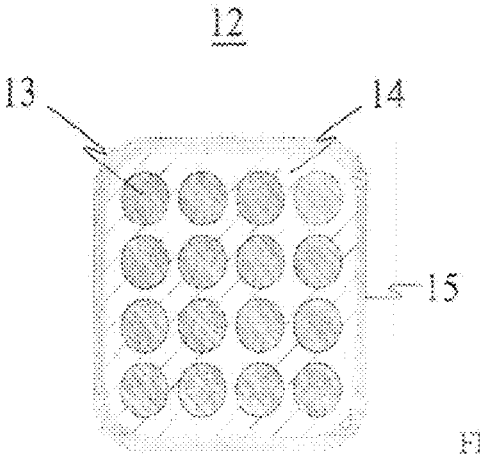
FIG. 6 is an illustration of a cross-sectional view of a composite material utilized within a spall liner region of the composite armor of FIG. 1.
Figure 7:
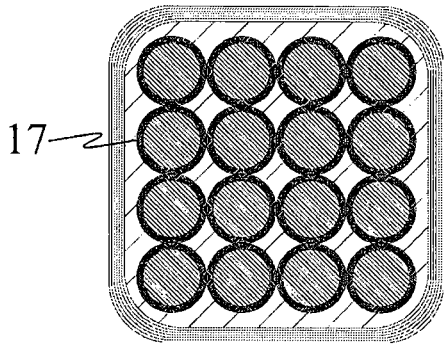
FIG. 7 is an illustration of a cross-sectional view of another composite material utilized within the spall liner region of the composite armor of FIG. 1.

The spall liner (3) component of the composite armor design comprises a strong reinforcing material with long range periodicity such as woven carbon fiber, woven S2 glass, or woven Kevlar. A representative block of spall liner material is shown as (12) in FIG. 6 below. FIG. 6 illustrates in cross-section a woven fibrous composite panel with a polymer matrix (14) for a single tow of reinforcing fiber (13). The exterior of this fibrous panel has been further reinforced with a nano-/microlaminated metal coating (15). In a variant (16) of the previous embodiment shown as FIG. 7, the fibers themselves may be reinforced with a thin nanolaminated metal sheath (17) prior to polymer infusion. A further embodiment replaces the polymer matrix entirely with a nanolaminated metal, infused through a non-conductive woven fiber material (e.g. S2 glass, Kevlar) or conformally plated onto a conductive fiber material (e.g. graphite, metalized S2 glass, or metalized Kevlar).

Figure 9A:
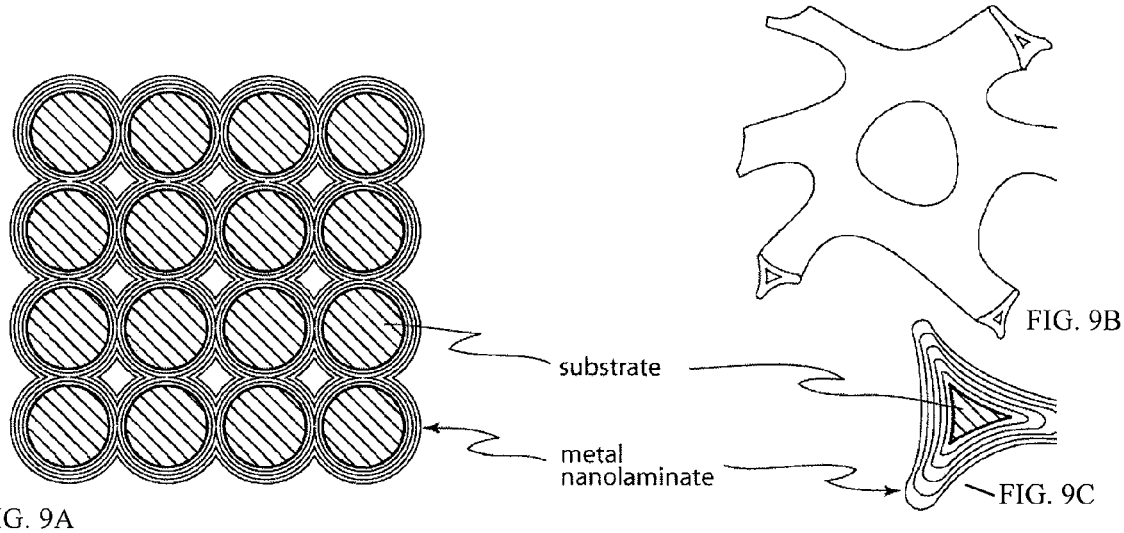
FIG. 9*a* is an illustration of a cross-sectional view of a porous substrate formed from a carbon fiber tow reinforced with an electrodeposited nanolaminated metal.

The nano- and/or microlaminated materials included in the strike face, core layer, and/or the spall liner can be produced by electrodeposition (electroplating) under controlled, time-varying conditions. These conditions include one or more of the following: applied current, applied voltage, rate of agitation, and concentration of one or more of the species within the electroplating bath (e.g., a bath including one or more of an electrodepositable species such as nickel, iron, copper, cobalt, gold, silver, zinc, or platinum). Nano- or microlaminations are defined here as spatial modulations, in the growth direction of the electrodeposited material, in structure (e.g. grain size, crystallographic orientation, phase), composition (e.g. alloy composition), or both. Nanolaminates include a modulation wavelength that is less than 1 micron—i.e., the modulation wavelength is nanoscale. (See International Patent Publication No. WO2007021980 for a further description of nanolaminate materials and electrodeposition of nanolaminate materials; WO2007021980 is herein incorporated by reference in its entirety.) Microlaminates include a modulation wavelength that is less than 1000 microns. Metal nano- or microlaminates can be applied over a variety of substrates (e.g., preforms). In some embodiments the substrate includes a porous preform such as a honeycomb, fiber cloth or batting (woven or nonwoven), a reticulated foam (see FIGS. 5*a*, 5*b*, 5*c* and 9*b* and 9*c*), or a tow of fibers (see FIG. 9*a*), most of which possess little structural integrity in their original form, and can therefore be shaped to the desired component geometry prior to electrodeposition. In addition, metal nano- or microlaminates can be deposited throughout a porous preform formed of an unconsolidated material (e.g., a bed of powder or beads) or through a porous preform created by perforated ceramic plates or tiles. Metal laminates can be deposited into the open, accessible interior void structure of a porous preform, as well as on an exterior surface of any preform (solid substrate or porous preform). Furthermore, plating conditions (i.e. parameters) can be controlled to effect both uniform nano- or microlaminate growth throughout the preform, as well as preferential growth and densification near the external surface of the porous preform. That is, deposition of the nano- or microlaminate material can be controlled such that the laminate's thickness increases throughout the porous preform (or at least a portion of the preform). In this fashion, all three layers (1, 2, and 3) of the armor can be produced in a single production run without removing the part from the plating tank.

Methods and Materials

In some embodiments, nano- and/or microlaminated materials included within the strike face, the core layer, and/or the spall liner can include compositionally or structurally modulated materials. The compositionally modulated or structurally modulated materials can be formed through the use of electrodeposition. Some exemplary electrodeposition techniques and materials are provided within this section entitled "Methods and Materials." These techniques and materials are not meant to be exhaustive, but rather are merely illustrative of possible embodiments of the technology disclosed herein.

The term "compositionally modulated" describes a material in which the chemical composition varies throughout at least one spatial coordinate, such as, for example, the material's depth. For example, in an electrochemical bath including a nickel-containing solution and an iron-containing solution, the resulting compositionally modulated electrodeposited material 20 (FIG. 8) includes alloys having a chemical make-up according to $Ni_xFe_{1-x}$, where x is a function of applied current or voltage and mass transfer coefficient at the deposition surface. Thus, by controlling or modulating at least one of the mass flow of the bath solution or the applied current or voltage to electrodes, the chemical make-up of a deposited layer can be controlled and varied through its depth (i.e., growth direction). As a result, a compositionally modulated electrodeposited material, as illustrated by material 20 shown in FIG. 8, may include several different alloys as illustrated by layers 30, 32, 34, 36, and 38.

A "structurally modulated material" is similar to a compositionally modulated material, except that in a structurally modulated material the structure (e.g., grain size, phase, crystallographic orientation, etc.) is modulated rather than the composition. The remainder of this section will describe compositionally modulated materials. However, the same techniques can be used to create structurally modulated materials as well. For example, electrodeposition variables such as the flow rate which affects the deposition rate can be manipulated to grow the deposited material with a finer or larger grain size. Similarly, the growth rate and constituents of the deposited material can be manipulated to control the phase of the electrodeposited material.

Figure 8:
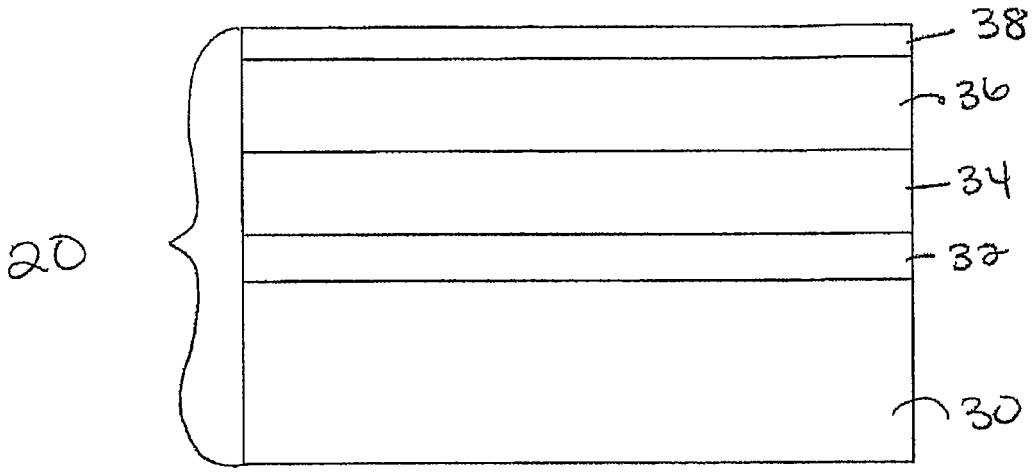
FIG. 8 is an illustration of a cross-sectional view of an embodiment of an electrodeposited compositionally modulated material.

Referring to FIG. 8, layers 32 and 36 represent nickel-rich (x>0.5) deposits in a compositionally modulated laminate material, whereas layers 30, 34, and 38 represent iron-rich (x<0.5) deposits. While layers 32 and 36 are both nickel rich deposits, the value for x in each of layers 32 and 36 need not be the same. For example, the x value in layer 32 may be 0.7 whereas the x value in layer 36 may be 0.6. Likewise, the x values in layers 30, 34, and 38 can also vary or remain constant. In addition to the composition of the constituents (e.g., Ni and Fe) varying through the depth of the electrodeposited material 20, a thickness of each of the layers 30 to 38 varies through the depth as well. FIG. 8, while not to scale, illustrates the change or modulation in thickness that can be made through the layers 30, 32, 34, 36, and 38.

Figure 10:
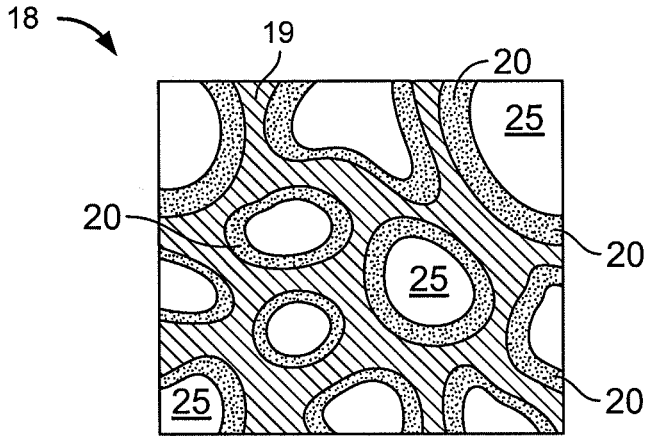
FIG. 10 is an illustration of a cross-sectional view of a composite material. This composite material includes a consolidated porous substrate with a compositionally modulated electrodeposited material filling at least a portion of an open, accessible void structure of the porous substrate.
Figure 11:
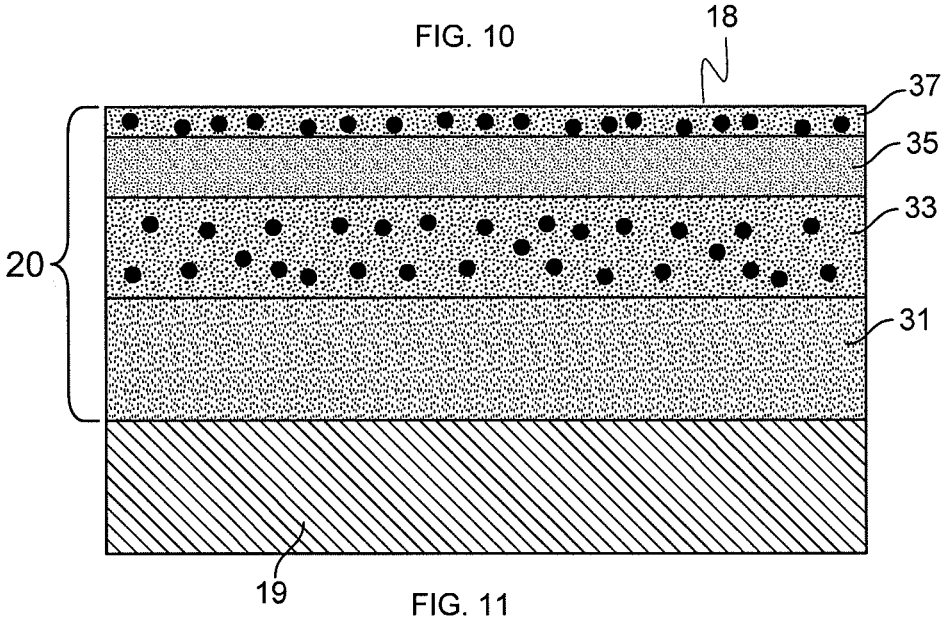
FIG. 11 is an illustration of a cross-sectional view of the compositionally modulated material of FIG. 10 along one of the voids.

FIGS. 10 and 11 illustrate a different embodiment of a composite material 18 (e.g., a material included in one or more of layers 1, 2, or 3 of the armor in FIG. 1). In this embodiment, a porous substrate 19 is a consolidated porous body. That is, the porous substrate 19 in this embodiment is a unitary piece that includes a plurality of voids 25 that define an accessible, interior void structure. Examples of consolidated porous bodies include, foams, fabrics, meshes, fibrous panels, ceramic plates, ceramic titles, and partially sintered compacts. The compositionally modulated material 20 (a different embodiment than shown in FIG. 8) is electrodeposited throughout the accessible, interior void structure to form a coating along the walls of the porous substrate 19 defining the voids 25.

Referring to FIG. 11, the compositionally modulated material 20 disposed within the plurality of voids 25 (as shown in FIG. 10) includes multiple alloys illustrated as distinct layers 31, 33, 35, and 37. As described above, the compositionally modulated material 20 is varied in both constituent concentration (i.e., to form the different alloy layers making up the material 20) and in thickness of the layers. In the embodiment shown in FIG. 11, nickel-rich layers 33 and 37 further include a concentration of particles disposed therein, thereby forming particle-reinforced composite layers. As shown in FIG. 11, layers 33 and 37 need not include the same concentration of particles, thereby allowing the compositionally modulated material 20 to be further tailored to provide optimal material properties. While not wishing to be bound by any particular theory, it is believed that increasing the concentration of the particles in a layer increases the hardness of that particular layer. The concentration of particles per layer can be controlled through modulating the flow rate of the bath during electrodeposition. The particles can have any shape, such as spherical particles, pyramidal particles, rectangular particles, or irregularly shaped particles. In addition, the particles can be of any length scale, such as for example, millimeter sized (e.g., 1 to 5 millimeter), micron-sized (e.g., 100 microns to 0.1 microns), nanometer sized (e.g., 100 nm to 1 nm). In some embodiments, 85% or more (e.g., 87%, 89%, 90%, 93%, 95%, 96%, 97%, 98%, 99%, 100%) of the nanosized particles have an average grain size within a range of 10 nm to 100 nm. In certain embodiments, 85% or more of the nanosized particles have an average grain size within a range of 20 nm to 50 nm, 30 nm to 50 nm, 10 nm to 30 nm, or 1 to 10 nm. Examples of some suitable particles include carbide particles, alumina particles, glass particles, polymer particles, silicon carbide fibers, and clay platelets.

Figure 12:
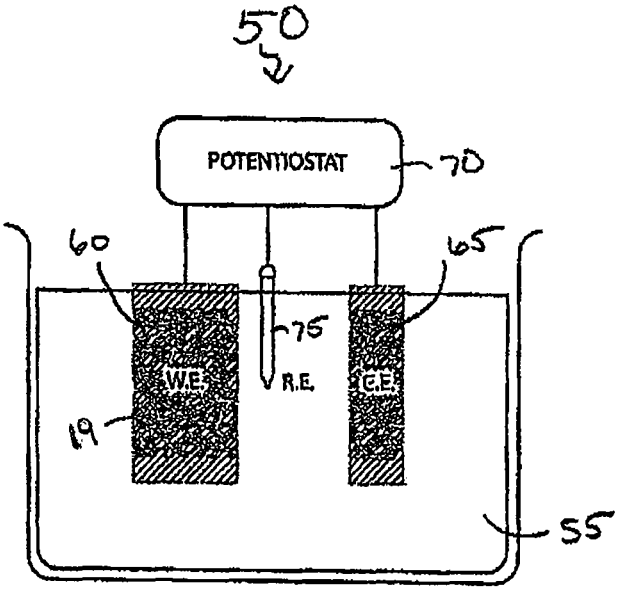
FIG. 12 is an illustration of an electroplating cell including a working electrode attached to a porous substrate.

To form or deposit the compositionally modulated electrodeposited material 20, the porous substrate 19 can be submerged into an electrochemical cell. Referring to FIG. 12, an electrodeposition cell 50, in one embodiment, includes a bath 55 of two or more of metal salts, a cathode (i.e., working electrode) 60, an anode (i.e., a counter electrode) 65, and a power supply (e.g. a potentiostat) 70, which electrically connects and controls the applied current between the working and counter electrodes, 60 and 65, respectively. The cell 50 can also include a reference electrode 75 to control the potential of the substrate relative to a fixed, known reference potential. In general, when an electrical current is passed through the cell 50, an oxidation/reduction reaction involving the metal ions in the bath 55 occurs and the resulting product is deposited on the working electrode 60. As shown in FIG. 12, the porous substrate 19 is positioned in contact with the working electrode 60. For example, in certain embodiments, the porous substrate is formed of a conductive material and functions as an extension of the working electrode 60. As a result, the resulting product of the oxidation/reduction reaction deposits within the accessible interior void structure. In other embodiments, the porous substrate 19 is formed of a nonconductive material and thus, electrodeposition occurs at a junction between the working electrode 60 and the porous substrate 19.

In general, one of the advantages of the methods and resulting composite materials described in this disclosure is a wide range of choices of materials available for deposition into the interior void structure 25 of the porous preform 19 or on the exterior of a porous or solid preform. For example, salts of any transition metal can be used to form the bath 55. Specifically, some preferred materials include salts of the following metals: nickel, iron, copper, cobalt, gold, silver, zinc, and platinum. In addition to the wide range of materials available, electrodeposition techniques have an additional advantage of easily modifiable processing conditions. For example, a ratio of the metal salts and other electrodepositable components, such as, for example, alumina particles, can be controlled by their concentration within the bath. Thus, it is possible to provide a bath that has a Ni:Fe ratio of 1:1, 2:1, 3:1, 5:1, 10:1 or 20:1 by increasing or decreasing the concentration of a Fe salt within the bath in comparison to the Ni salt prior to deposition. Such ratios can thus be achieved for any of the electrodepositable components. Where more than two electrodepositable components are provided, such ratios can be achieved as between any two of the components such that the overall ratios for all components will be that which is desired. For example, a bath with Ni, Fe and Cu salts could yield ratios of Ni:Fe of 1:2 and a Ni:Cu of 1:3, making the overall ratio of Ni:Fe:Cu 1:2:3. In addition, a bath with Ni salt and alumina particles could yield a ratio of Ni:$Al_2O_3$ of 2:1, 2:1, 1:2, 3:1 or 1:3 by increasing or decreasing the concentration of particles within the bath.

Figures 13A, 13B, 13C:
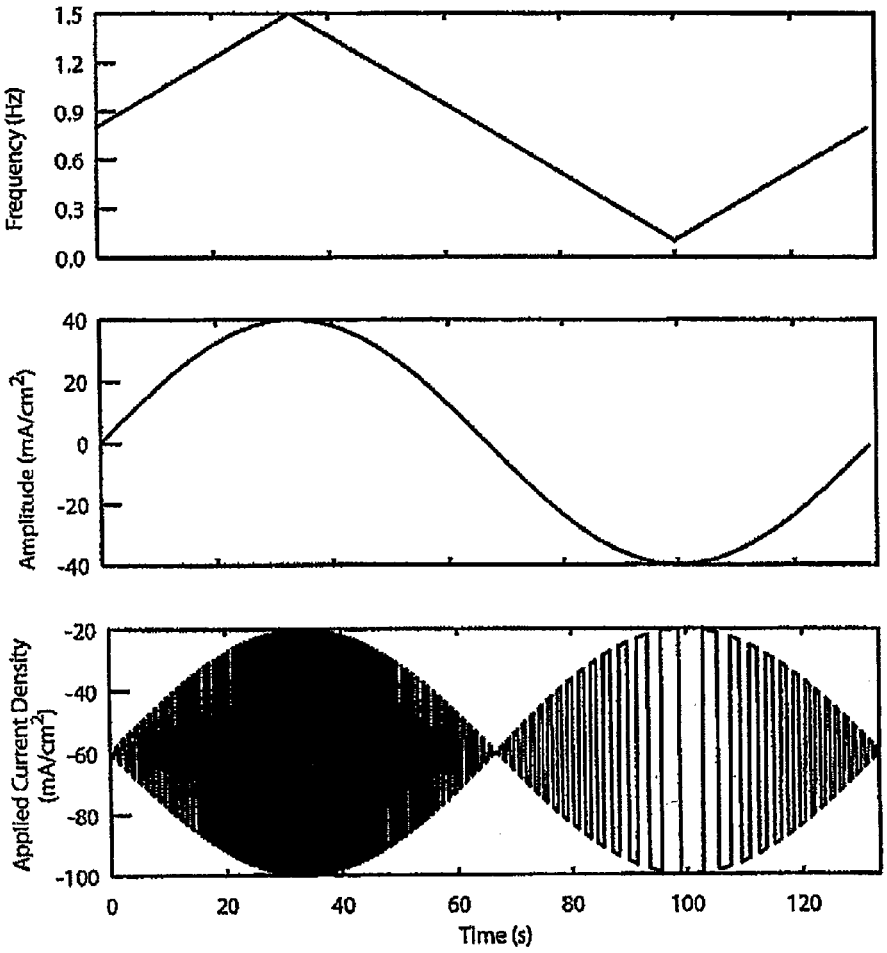
FIGS. 13*a*, 13*b*, 13*c*, 13*d*, 13*e* are graphs showing electrodeposition conditions and resulting compositional maps for the deposition conditions.
Figure 13D:
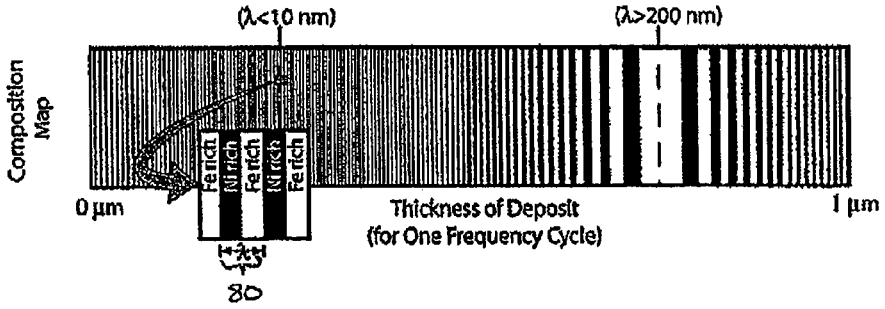

FIGS. 13A, 13B, and 13C illustrate applied conditions to an electrochemical cell, such as that illustrated as 50 in FIG. 12, for depositing the compositionally modulated material 20. FIG. 13D illustrates a resulting composition map for the applied conditions shown in FIGS. 13A, 13B, and 13C. FIG. 13C shows the current density over a period of 130 seconds applied to a working electrode (e.g., working electrode 60 in FIG. 12). The applied current drives the oxidation/reduction reaction at the electrode to deposit a material product having the form $A_xB_{1-x}$, where A is a first bath constituent and B is a second bath constituent. While FIG. 13C illustrates a current density range of between −20 to −100 mA/cm$^2$, other current density ranges are also possible for example, a current density range of between about −5 to −20 mA/cm$^2$ may be advantageous in some embodiments.

Another way of tailoring the modulation of the compositions of the deposited alloys ($A_xB_{1-x}$, where x varies) is with respect to a composition cycle. Referring to FIG. 13D, a composition cycle 80 defines the deposition of a pair of layers. The first layer of the composition cycles is A-rich and the second layer is B-rich. Each composition cycle has a wavelength. A value assigned to the wavelength is equal to the thickness of the two layers forming the composition cycle 80. That is, the wavelength has a value that is equal to two times the thickness of one of the two layers forming the composition cycle (e.g., $\lambda$=10 nm, when thickness of Ni-rich layer within the composition cycle is equal to 5 nm). By including one or more composition cycles the deposited material is compositionally modulating. In an advantageous embodiment, the compositionally modulated electrodeposited material includes multiple composition cycles (e.g., 5 composition cycles, 10 composition cycles, 20 composition cycles, 50 composition cycles, 100 composition cycles, 1,000 composition cycles, 10,000 composition cycles, 100,000 composition cycles or more).

The applied current density as shown in FIG. 13C is determined from an applied variation in frequency of the current per time (FIG. 13A) in combination with an applied variation in amplitude of the current per time (FIG. 13B). Referring to FIG. 13A, an applied frequency modulation, shown here as a triangle wave, effects the wavelength of the composition cycles. As shown by comparing FIGS. 13A and 13D, the wavelength of the composition cycles decreases as the frequency increases. While FIG. 13A illustrates this effect with an applied triangle wave, any waveform (i.e., a value that changes with time) may be applied to control or modulate the frequency and thus control or modulate the thickness/wavelengths of the deposited material. Examples of other waveforms that may be applied to tailor the changing thickness/wavelength of each of the deposited layers/composition cycles include sine waves, square waves, sawtooth waves, and any combination of these waveforms. The composition of the deposit (i.e., x value) can also be further modulated by varying the amplitude. FIG. 13B illustrates a sine wave modulation of the applied amplitude of the current applied to the working electrode. By changing the amplitude over time, the value of x varies over time such that not all of the Ni-rich layers have the same composition (nor do all the Fe-rich layers have the same composition). Referring to FIGS. 3A and 3B, in some embodiments, the value of x is modulated within each of the layers, such that the compositionally modulated electrodeposited material is graded to minimize or mask composition discontinuities. As a result of applying one or more of the above deposition conditions, the compositionally modulated electrodeposited material can be tailored to include layers that provide a wide range of material properties and enhancements.

One such enhancement is an increase in hardness. Without wishing to be bound to any particular theory, it is believed that regions of nanolaminate material (i.e., regions in which all of the composition cycles have a wavelength less than about 200 nm and preferably less than about 80 nm) exhibit a hardness not achievable by the same materials at greater wavelengths. This hardness is believed to arise from an increase in the material's elastic modulus coefficient, and is known as the "supermodulus effect." In certain embodiments, for example, the composite material 20 of FIG. 11, the compositionally modulated electrodeposited material 20 is deposited to include one or more regions, which provide the composite material 18 with the supermodulus effect. That is, the compositionally modulated electrodeposited material 20 disposed within the void structure 25 of the porous substrate 19 or on an exterior surface of a solid or porous substrate includes one or more regions in which all of the composition cycles include wavelengths less than 200 nm, and preferably less than about 80 nm. In one embodiment, the wavelengths are less than about 70 nm. In another embodiment, the hardness of the composite material 18 is enhanced by including varying concentrations of particles (e.g., $Al_2O_3$, SiC, $Si_3N_4$) within an electrodeposited metal. For example, by increasing the concentration of $Al_2O_3$ particles dispersed within layers of an electrodeposited Ni metal, an increase in Vicker's Hardness from 240 VHN to 440 VHN is achievable.

In some embodiments, the compositionally modulated electrodeposited material can include regions in which the composition cycles include wavelengths less than 200 nm (and thus which may exhibit the supermodulus effect) and also include regions in which some portion (e.g., at least or about: 1%, 2%, 5%, 7%, 10%, 20%, 30%, 40%, 50%, 60%, 70%, 80%, 90%, 92% 95%, 97%, 99% and 100%) of the composition cycles include wavelengths greater than 200 nm. The portion(s) of the composition cycles that include wavelengths greater than 200 nm could also be represented in ranges. For example, the composition cycles of one or more regions could include a number of wavelengths greater than 200 nm in a range of from 1-2%, 2-5%, 1-5%, 5-7%, 5-10%, 1-10%, 10-20%, 20-30%, 30-40%, 40-50%, 50-60%, 60-70%, 70-80%, 80-90%, 90-92%, 90-95%, 95-97%, 95-99%, 95-100%, 90-100%, 80-100%, etc., with the balance of the composition cycles being less than 200 nm in that region. Without wishing to be bound by any particular theory, it is believed that, as hardness increases, ductility decreases. As a result, in order to provide a composite material that is enhanced to include regions of increased hardness and regions of increased ductility, the compositionally modulated electrodeposited material, in some embodiments, can include one or more regions in which all of the composition cycles have a wavelength of about 200 nm or less including wavelengths less than 1 nanometer, one or more regions in which all of the composition cycles have a wavelength greater than 200 nm, and/or one or more regions in which a portion of the composition cycles have a wavelength of about 200 nm or less and a portion have a wavelength greater than 200 nm. Within each of those portions, the wavelengths also can be adjusted to be of a desired size or range of sizes. Thus, for example, the region(s) having composition cycles of a wavelength of about 200 nm or less can themselves have wavelengths that vary from region to region or even within a region. Thus, is some embodiments, one region may have composition cycles having a wavelength of from 80-150 nm and another region in which the wavelengths are less than 80 nm. In other embodiments, one region could have both composition cycles of from 80-150 nm and less than 80 nm.

In certain embodiments, the compositionally modulated material can be tailored to minimize (e.g., prevent) delamination of its layers during use. For example, it is believed that when a projectile impacts a conventional laminated material, the resulting stress waves may cause delamination or debonding due to the presence of discontinuities. However, the compositionally modulated electrodeposited materials described herein can include a substantially continuous modulation of both its composition (i.e., x value) and wavelength such that discontinuities are minimized or eliminated, thereby preventing delamination.

Figure 14B:
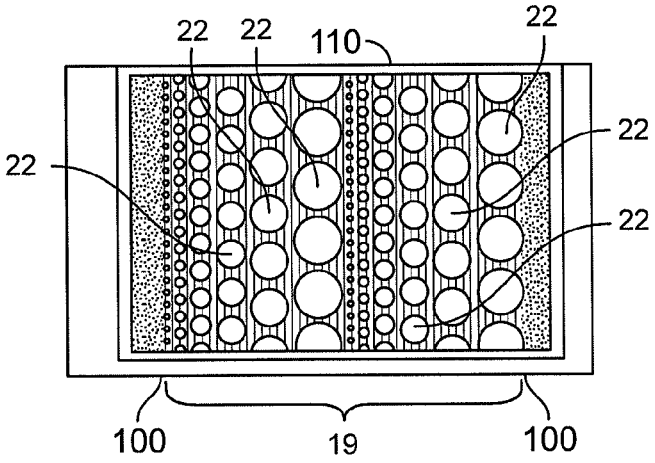
Figure 14C:
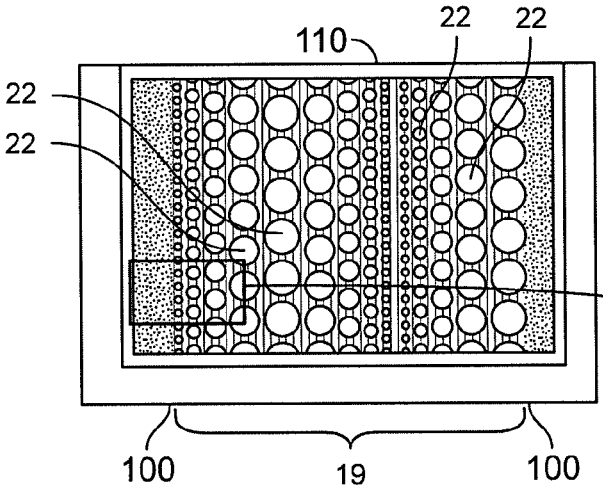

Referring to FIGS. 14A-14C, a different embodiment of a compositionally modulated material 20 is shown. In addition to compositionally modulating the electrodeposited material 20 to form the composite 18, the porous substrate material 19 can also be made of a material that is modulated through its depth. For example, as shown in FIG. 14A, in one embodiment, the porous substrate 19 is formed of particles 22 that gradually increase in size from an exterior 100 of the compact to an interior 110 of the composite 18. The particles in such embodiments can range from, e.g., 5 nm on the exterior 100 to 50 microns in the interior 110, 5 nm on the exterior 100 to 10 microns in the interior 110, 5 nm on the exterior to 1 micron in the interior 110, 10 nm on the exterior 100 to 10 microns in the interior 110, or from 10 nm on the exterior 100 to 1 micron in the interior. The differently sized particles 22 contribute to the material properties of the composite 18. For example, smaller particles have a greater surface area energy per unit volume than larger particles of the same material. As a result, the porous substrate 19 can be tailored to provide additional advantageous material properties to different regions of the composite 18. Referring to FIGS. 15B and 15C, the porous substrate 19 can have other particle arrangements to provide different material properties to the composite 18. For example, in FIG. 15B the particles have a repetitive size distribution and in FIG. 15C the particles have a graded distribution.

FIGS. 15A and 15B show an enlarged cross-sectional view of the compositionally modulated electrodeposited material 20 disposed between four adjacent particles 22 of a porous substrate 19. In FIG. 16A, the particles 22 forming the porous substrate 19 are non-conductive particles (e.g., alumina particles, glass particles). As a result of their non-conductivity, electrodeposition occurs between two electrodes disposed on either end of the porous substrate 19 and the compositionally modulated electrodeposited material 20 is deposited in a bottom-up fashion. Thus, the compositionally modulated electrodeposited material fills the entire void structure 25 between the four particles. In the embodiment shown in FIG. 15B, the particles 22 are electrically conductive. As a result, electrodeposition can occur within the conductive porous material to produce layers that are initiated at a particle/void interface 120 and grow inwards to fill at least a portion of the interior void structure 25.

Figure 16:
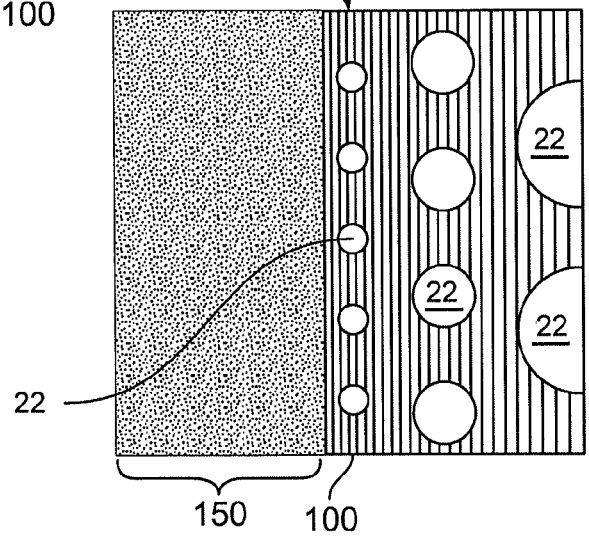
FIG. 16 is an illustration of a cross-sectional view of an embodiment of a composite material including a nanostructured capping layer deposited on an exterior surface of a porous substrate.
Figure 17:
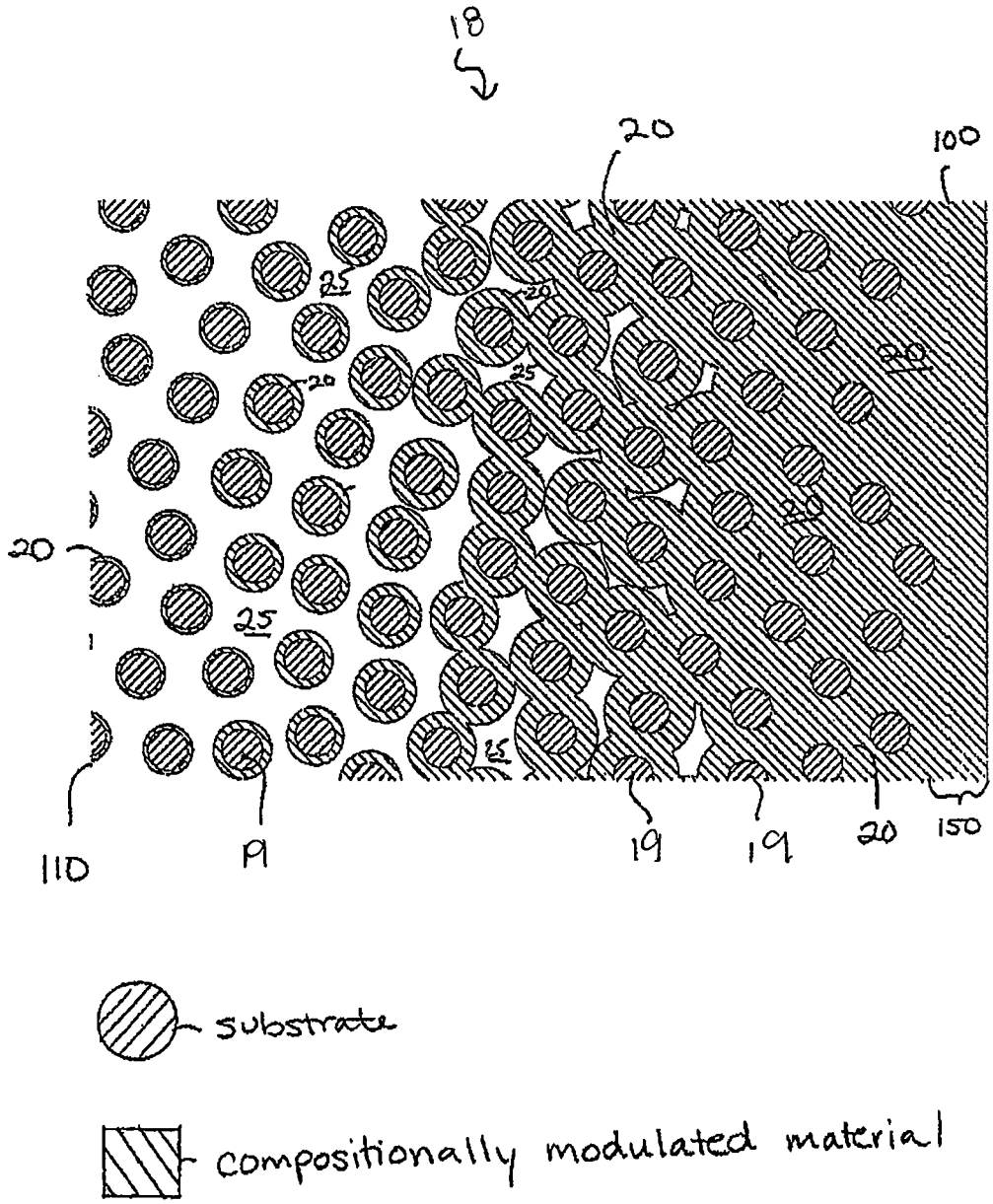
FIG. 17 is an illustration of a cross-sectional view of an embodiment of a consolidated, conductive porous substrate with a tailored filling of a compositionally modulated electrodeposited coating disposed within its accessible void structure. Deposition conditions for this embodiment have been tailored to not only vary a thickness of the coating throughout the depth of the consolidated conductive porous substrate, but also to cap or seal the composite with a dense compositionally modulated layer that closes off accessibility to the interior void structure.

As illustrated in the embodiments of FIG. 16 and FIG. 17, in addition to electrodepositing into a porous preform, the compositionally modulated material 20 can also be deposited on the exterior surfaces 100 of the porous substrate 19 to form a nanolaminate or microlaminate coating. For example, after the accessible interior void structure 25 is at least partially filled in the case of an electrically conductive porous substrate or substantially filled in the case of a non-conductive porous substrate, an additional or capping layer 150 can be deposited onto the substrate to seal off the interior porous structure 25 as shown in FIG. 17.

In certain embodiments, the filling of the accessible interior void structure 25 is tailored such that the thickness of the compositionally modulating electrodeposited material 20 varies throughout the composite 18. For example, FIG. 17 illustrates a composite material 18 formed of a porous conductive foam 19 and a $Ni_xFe_{1-x}$ compositionally modulated material 20. The thickness of the compositionally modulated material 20 continuously increases (i.e., thickens) from the interior portion 110 of the porous substrate 19 to the exterior 100. To create this thickening, the current density during deposition is continuously increased. In addition to including the compositionally modulated material 20 disposed throughout the void structure 25 of the porous substrate 19, a dense layer of the compositionally modulated material, referred to as the capping layer 150 is further applied to the exterior 100 of the substrate 19 to close off the accessible pore structure 25.

Methods of forming the composite 18 using electrodeposition can include the following steps: (1) forming a bath including at least two electrodepositable components, (2) connecting a preform, such as, for example the porous perform 19, to the working electrode 60, (3) inserting the preform, the working electrode 60, and the counter electrode 65 into the bath 55, and (4) applying a voltage or current to the working electrode 60 to drive electrodeposition.

Figure 13E:
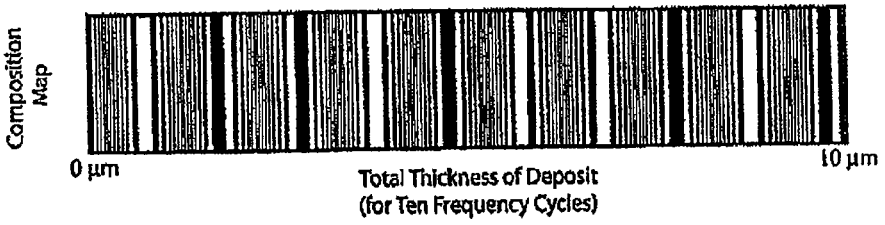

In general, in one embodiment, the voltage or current applied to the working electrode 60 varies over time so that the compositionally modulated material is electrodeposited into the voids 25 of the porous preform 19. Thus, in some embodiments, the voltage or current is applied to the electrode 60 with a time varying frequency that oscillates in accordance with a triangle wave. In other embodiments, the voltage or current is applied to the electrode with a time varying frequency that oscillates in accordance with a sine wave, a square wave, a sawtooth wave, or any other waveform, such as a combination of the foregoing waveforms. The voltage or current can be applied for one waveform cycle as shown in FIG. 13A, or preferably for two or more cycles (e.g., three cycles, five cycles, 10 cycles, 20 cycles). FIG. 13E shows the envisioned composition map for a 10 cycle deposit.

In addition to controlling the voltage or current, other deposition conditions can also be monitored and varied to tailor the compositionally modulating material 20. For example, it is believed that the pH of the bath has an effect upon the quality of the deposited material. Thus, in some embodiments, the pH of the bath is controlled during electrodeposition. For example, prior to deposition a pH set point (e.g., a pH of 1, 2, 3, 4, 5, 6, 7, 8, 9, 10, 11, 12, 13 or 14) or range (e.g., a pH of 1-2, 2-3, 3-4, 5-6, 6-7, 7-8, 8-9, 9-10, 10-11, 11-12, 12-13, or 13-14) is determined. During electrodeposition, the pH of the bath is monitored and if a difference from the set point is determined, pH altering chemicals, such as, for example, HCl, $H_2SO_4$, sulfamic acid, or NaOH, are added to the bath to return the bath to its pH set point.

The concentration of the electrodepositable components in the bath can also be monitored and controlled. For example, concentration sensors can be positioned within the cell 50 to monitor the concentrations of the metal salts as well as any depositable particles within the bath. During electrodeposition of the compositionally modulated material 20, the concentrations of the depositable components (e.g., metal salts, particles) can become depleted or at least decreased from a predetermined optimal level within the bath. As a result, the timeliness of the deposition of the compositionally modulated material 20 can be effected. Thus, by monitoring and replenishing the concentrations of the depositable components electrodeposition can be optimized.

In certain embodiments, flow rate of the bath can be modulated or varied. As described above, both the applied current or voltage and the mass flow rate of the depositable components effects the x-value of the electrodeposit (e.g., $Ni_xFe_{1-x}$). Thus, in some embodiments, the flow rate of the bath containing the depositable components is varied in addition to the applied voltage or current to produce the modulation in the value of x. In other embodiments, the applied voltage or current remains constant and the flow rate is varied to produce the modulation in the value of x. The flow rate of the bath can be increased or decreased by providing agitation, such as, for example, a magnetically-controlled mixer or by adding a pump to the cell 50. By agitating the bath or by agitating the preform the mass transfer rate of the electrodeposited material is effected in that electrodepositable species may be more readily available for deposition thereby providing improved deposition conditions.

Figure 18:
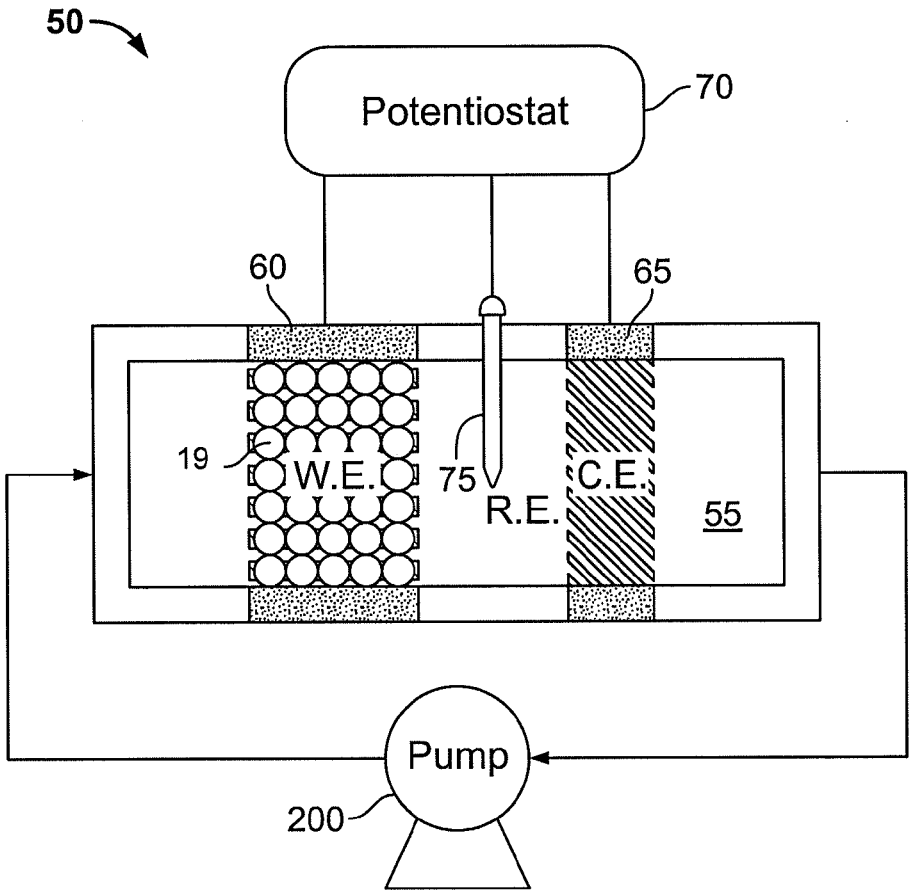
FIG. 18 is an illustration of a flow cell for electrodepositing a compositionally modulated material into a void structure of an electrically conductive porous substrate.
Figure 19:
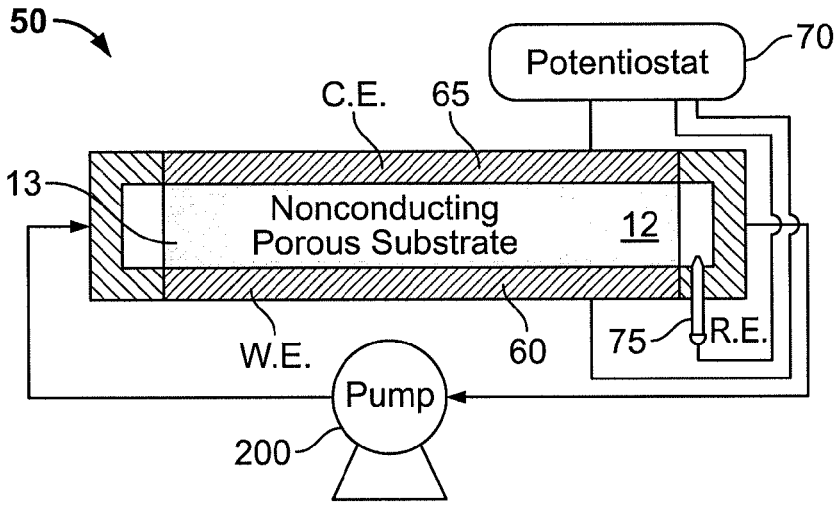
FIG. 19 is an illustration of a flow cell for electrodepositing a compositionally modulated material into a void structure of an electrically non-conductive porous substrate.

FIGS. 18 and 19 illustrate embodiments of an electrochemical cell 50 that includes a pump 200. In general, these cells 50 are referred to as flow cells because they force a bath solution through a porous substrate. Referring to FIG. 18, the flow cell includes a porous working electrode 60, which is also the porous electrically-conductive substrate 19, and a porous counter electrode 65. The working electrode 60, the counter electrode 65 and the reference electrode 75 are in communication and are controlled by the potentiostat 70. The bath fluid 55 including the depositable components is forced through the porous working electrode 60 (and thus the porous substrate 19) and the counter electrode 65 at a flow rate adjustable at the pump 200. Thus, in certain embodiments, the flow rate of the pump 200 can be controlled in accordance with a triangle wave, square wave, sine wave, a saw tooth wave, or any other waveform, such that the flow rate can be modulated to produce the compositionally modulated material 20.

FIG. 19 illustrates another embodiment of a flow cell 50 for use with non-conductive porous substrates 19. In this cell 50, the working electrode 60 and the counter electrode 65 are disposed within a wall of the cell 50 and the bath fluid 55 is forced through the porous non-conductive substrate 19. Electrodeposition occurs in a bottom-up fashion, that is, the deposition of material 20 proceeds from the working electrode 60 to the counter electrode 65 substantially filling the void structure along the way.

The methods and composite materials described herein can be tailored to provide the unusual combination of strength, ductility, and low-density. For example, the porous substrate 19 forming the matrix of the composite material 18 can be formed of a light-weight ceramic material or can include a relatively large amount (e.g., 40% by volume, 50% by volume, 60% by volume) of accessible interior void space 25. The compositionally modulated material 20 electrodeposited into the accessible, interior void space 25 can be tailored to provide strength at least in part through nanolaminate regions and ductility at least in part through micron or submicron sized laminated regions.

In some embodiments, the composite material 18 is deposited on a solid preform (e.g., substrate) and/or a porous preform with closed porosity instead of a porous substrate with open porosity. In these embodiments, the composite material 18 is deposited on the exterior surface of the preform.

What is claimed is:

1. A method for producing a composite armor material comprising a strike face region, a core region, and a spall liner region, the method comprising: i) providing an electrolyte containing one or more electrodepositable species; ii) providing a reticulated foam porous substrate; iii) immersing the porous substrate in the electrolyte; iv) passing an electric current through the porous substrate so as to deposit a metal material onto the porous substrate and changing one or more plating parameters in predetermined durations between a first value which is known to produce a material with one property and a second value known to produce a nanolaminate metal material or a microlaminate metal material with a second property to form a portion of the core region comprising the reticulated foam and a nanolaminate metal material or a microlaminate metal material applied to said foam, either of which is formed from the one or more electrodepositable species by passing the electric current through the porous substrate;

wherein at least a portion of said strike face region is produced by electrodepositing a tough metal phase through one or more ceramic tiles; and wherein said spall liner region comprises fibers and a nanolaminate metal material or a microlaminate metal material, in which a) the fibers are reinforced with a sheath formed of a nanolaminate metal material, b) the fibers are disposed within a matrix of a nanolaminate metal material, c) the fibers are present within a panel having the fibers as part of a woven fabric within a polymer matrix, where the exterior of the panel is reinforced with a nanolaminate metal coating or a microlaminate metal coating, or d) the fibers, which are reinforced with a nanolaminate metal sheath, are present within a panel having the fibers as part of the woven fabric within a polymer matrix, where the exterior of the panel is reinforced with a nanolaminate metal coating or a microlaminate metal coating.

2. The method of claim 1, wherein the fibers are disposed within a matrix of a nanolaminate metal material.

3. The method of claim 1, wherein the fibers form a reinforcing material with long range periodicity.

4. The method of claim 3, wherein said reinforcing material with long range periodicity is selected from the group consisting of: woven carbon fiber, woven aluminosilicate glass, or woven para-aramid synthetic fiber.

5. The method of claim 1, wherein said plating parameters are independently selected from: pH of electrolyte, electrolyte composition, applied plating current, applied plating voltage, and mass transfer rate.

6. The method of claim 1, wherein said porous substrate is formed into desired component geometry prior to passing electric current through the porous substrate so as to deposit said metal.

7. The method of claim 1, wherein said one or more ceramic tiles are perforated ceramic tiles or an array of ceramic tiles.

8. The method of claim 7, wherein said one or more ceramic tiles are perforated ceramic tiles.

9. The method of claim 7, wherein said one or more ceramic tiles is an array of ceramic tiles.

10. The method of claim 1, wherein said electrolyte comprises two or more metal salts.

11. The method of claim 1, wherein said strike face region produced by electrodepositing a tough metal phase through one or more ceramic tiles comprises a laminated metal material.

12. The method of claim 1, wherein said core region comprises the reticulated foam porous substrate, in which void regions of the porous substrate are optionally filled by a gas, liquid, polymer, or solids with a density less than 5 g/cc.

13. The method of claim 12, wherein the core region comprises a compliant phase, which includes a polymer or solid, each with a density less than about 5 g/cc.

14. The method of claim 1, wherein said core region comprises the reticulated foam porous substrate, wherein the core region comprises less than 50% of a metal phase reinforcing and/or binding the reticulated foam, and wherein the core region optionally includes gases, liquids, polymers, or solids with a density less than 5 g/cc.

15. The method of claim 1, wherein the fibers of the spall liner are reinforced with a sheath of nanolaminate metal material.

* * * * *